US007476642B2

(12) United States Patent
Shimoyama et al.

(10) Patent No.: US 7,476,642 B2
(45) Date of Patent: Jan. 13, 2009

(54) THERMALLY SENSITIVE RECORDING MEDIUM

(75) Inventors: Mizuho Shimoyama, Tokyo (JP); Kaoru Hamada, Tokyo (JP); Seiki Yoneshige, Tokyo (JP); Kenji Hirai, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 261 days.

(21) Appl. No.: 10/564,808

(22) PCT Filed: Jul. 16, 2004

(86) PCT No.: PCT/JP2004/010529

§ 371 (c)(1),
(2), (4) Date: Jan. 13, 2006

(87) PCT Pub. No.: WO2005/007419

PCT Pub. Date: Jan. 27, 2005

(65) Prior Publication Data

US 2007/0231513 A1 Oct. 4, 2007

(30) Foreign Application Priority Data

Jul. 18, 2003 (JP) ..... 2003-276741

(51) Int. Cl.
*B41M 5/42* (2006.01)

(52) U.S. Cl. ..... 503/226; 427/150; 427/152; 503/200

(58) Field of Classification Search ..... None
See application file for complete search history.

(56) References Cited

U.S. PATENT DOCUMENTS 4,636,819 A 1/1987 Nagamoto et al.

FOREIGN PATENT DOCUMENTS

EP 1 314 574 A1 5/2003

OTHER PUBLICATIONS

European Patent Office Search Report dated Sep. 29, 2006 (3 pages).

*Primary Examiner*—Bruce H Hess
(74) *Attorney, Agent, or Firm*—Flynn, Thiel, Boutell & Tanis, P.C.

(57) ABSTRACT

Provision of a thermally sensitive recording medium made up of an undercoating layer containing a pigment and a binder as main components and a thermally sensitive color-developing layer containing a colorless or pale-colored basic leuco dye and a color-developing agent which develops a color by reacting with said basic leuco dye as main components on a substrate, wherein the undercoating layer contains a water-retention agent and a pigment whose oil-absorbing capacity prescribed by JIS K 5105 is from 80 cc/100 g to 120 cc/100 g as a pigment. Further, the solids concentration of a coating for the undercoating layer is from 25% to 45% and the dynamic water-retention capacity, which is Water retention measured with AA-GWR, is 350 g/m$^2$ or less.

8 Claims, No Drawings

THERMALLY SENSITIVE RECORDING MEDIUM

FIELD OF THE INVENTION

The present invention relates to a thermally sensitive recording medium which utilizes a color-developing reaction of a colorless basic leuco dye with a color-developing agent.

BACKGROUND OF THE INVENTION

In general, a thermally sensitive recording medium is prepared by pulverizing a colorless or pale colored basic leuco dye and a color-developing agent to fine particles respectively, mixing these two fine particles with additives such as a binder, a filler, a sensitizer, a slipping agent or others and forming a coating, then coating the obtained coating on a substrate such as paper, synthetic paper or plastics. The prepared thermally sensitive recording medium develops color by an instant chemical reaction by heating with a thermal head, a hot stamp, a thermal pen or laser and a recorded image can be obtained. A thermally sensitive recording medium is widely applied in a facsimile, a printer of computer, a bending machine for a ticket and a recorder of various measuring instruments. Recently, recording equipment has begun to have more diversity and high quality and, along with said tendency, high-speed printing and high-speed formation of images are becoming possible, and an excellent quality for the recording density of a thermally sensitive recording medium is required. Further, along with the diversibility of usage, the performance of a high quality recorded image is required in all regions from a lower density to a high density.

As a method of satisfying the above-mentioned requirements, a method of improving the surface smoothness of a thermally sensitive recording medium by a super calendar is ordinary carried out, however, a printed image of sufficient quality cannot always be obtained. Further, it is well known that the uniform coating of an undercoating layer is necessary for formation of a high-quality printed image, and a method of improving the smoothness of the undercoating layer, for example, using a super calendar is known. Still further, for the purpose of providing a thermally sensitive recording medium which is superior in dot reappearance, for example, a method to accumulate first and second intermediate layers is proposed in patent document 1.

Patent document 1; JP 2000-108518 publication

DISCLOSURE OF THE INVENTION

However, by the method using a super calendar, a porous feature of the undercoating layer is hurt by the calendar pressure, an adiabatic ability is lost and the sensitivity is deteriorated. Further, a method of accumulating a first intermediate layer and a second intermediate layer is disadvantageous from a manufacturing view point, because the process becomes more complicated. The object of the present invention is to provide a thermally sensitive recording medium characterized in having a high recording sensitivity and to be able to obtain high quality recorded images without causing the above problems.

The above object can be accomplished by a thermally sensitive recording medium comprising an undercoating layer containing a pigment and a binder as main components and a thermally sensitive color-developing layer containing a colorless or pale-colored basic leuco dye and a color-developing agent which develops a color by reacting with said basic leuco dye as main components on a substrate, wherein said undercoating layer contains a water-retention agent and a pigment whose oil-absorbing capacity (JIS K 5105) is from 80 cc/100 g to 120 cc/100 g as a pigment, further, the solids concentration of a coating for the undercoating layer is from 25% to 45% and the dynamic water-retention capacity (Water retention measured with AA-GWR) is 350 g/m$^2$ or less. As is well known in the art, AA-GWR water retention measurement is based on the pressure filtration of coatings under an externally applied air pressure of a certain time period and utilizes gravimetric determination of an aqueous phase penetrating through a filter and absorbed by a paper sample. It is desirable to use sodium alginate as a water-retention agent for the thermally sensitive recording medium.

The present invention is made by finding out that the penetrating condition of a coating fluid at the coating process (hereinafter shortened as a coating) for a paper becomes an important factor for a coating aptitude and quality. In particular, at a contact type coating system, such as blade coating, is characterized by pushing a coating into a paper. Therefore by evaluating the penetrating condition of the coating into the paper at a pressed condition, the coating aptitude of the coating can be known. Further the present invention pays attention to a relationship between the solid concentration and dynamic water-retention capacity (Water retention measured with AA-GWR) of a coating liquid for an undercoating layer, and it is important that the solid concentration is from 25% to 45% and dynamic water-retention capacity (Water retention measured with AA-GWR) is 350 g/m$^2$ or less.

DESCRIPTION OF THE PREFERRED EMBODIMENT

The preferred embodiment of the present invention will be illustrated as follows.

An undercoating layer of the present invention contains a pigment and a binder as main components, and solid concentration of a coating liquid is from 25% to 45%, desirably from 30% to 40%, and dynamic water-retention capacity (Water retention measured with AA-GWR) of a coating liquid is 350 g/m$^2$ or less, desirably is 300 g/m$^2$ or less.

Dynamic water-retention capacity used in the present invention is one of the methods to evaluate the characteristics of a coating which measures the penetration of the coating into a paper at a certain pressure and time and is indicated by g/m$^2$ unit. When this value is small, it means that a coating is hard to penetrate into a paper and more coating remains on the surface of a paper, and the coated quality becomes better. When the solids concentration of the coating liquid is higher, the water content is small and the water-retention ability deteriorates so that the coating aptitude becomes bad, while, when the concentration of the coating liquid is lower, the water content and water-retention ability become large, however, the viscosity of the coating liquid deteriorates and the coating aptitude becomes bad. On the other hand, in the present invention, an excellent coating aptitude can be obtained by maintaining the concentration of a coating liquid in a range from 25% to 45% and the dynamic water-retention capacity (Water retention measured with AA-GWR) to 350 g/m$^2$ or less. Wherein, the dynamic water-retention capacity (Water retention measured with AA-GWR) of the present invention is measured at the conditions of 23° C. temperature, 0.5 MPa pressure, for 40 minutes and 20 ml of liquid quantity using 1 sheet of filter paper.

The solids concentration and dynamic water-retention capacity of a coating liquid can be adjusted by the kind and adding quantity of a binder such as starch, polyvinylalcohol or carboxymethylcellulose, however, the viscosity under a high shearing speed can be easily elevated and a coating aptitude and quality changes. Therefore, the addition of a water-retention agent is most effective.

The kind of water-retention agent is not particularly restricted, and it is possible to adjust the features of water-retention ability or viscosity to the aptitude region of the present invention by properly controlling the adding amount. As a water-retention agent, an acrylic or a urethane synthetic water-retention agent, or sodium alginate can be mentioned. Especially, when sodium alginate is contained, good water-retention ability can be obtained by a small adding quantity, and by suppressing the penetration of a coating in a thermally sensitive recording medium which is excellent in recording sensitivity and has good quality of image can be obtained. Further, among sodium alginates, the use of a higher viscosity one is more desirable. In a case of sodium alginate of a lower viscosity, it is necessary to add a large quantity to perform a good water-retention ability, however, the use of large quantity has a tendency to deteriorate a recording sensitivity. In the present invention, sodium alginate whose Brookfield viscosity (B viscosity) of a 1% aqueous solution at 25° C. is 100 mPa·s or more is desirable, preferably 500 mPa·s or more is more desirable.

Further, it is desirable to use a water-retention agent by 0.01-1 weight parts to 100 weight parts of a pigment. A water-retention agent to be used in the present invention is considered to have an effect of improving the water-retention ability of a coating liquid and to prevent the penetration of a coating. When the blending parts of the water-retention agent is too small, a sufficient water-retention ability cannot be obtained, and when the blending parts is too large, coating work becomes impossible because the viscosity becomes too high. Accordingly, in the present invention, it is desirable to contain 0.01-1 weight parts of the water-retention agent, especially sodium alginate to 100 weight parts of the pigment. A more desirable amount is 0.01-0.8 weight parts to 100 weight parts of the pigment, and a furthermore desirable amount is 0.01-0.6 weight parts.

In the present invention, the reason why the excellent effect can be obtained is considered as follows. As one reason why the quality of the printed image deteriorates, a low concentration of the solids part of a coating liquid for an undercoat layer in a thermally sensitive recording medium can be mentioned. Although, depending on the materials to be used, aiming to obtain a good quality or dispersability of a coating, compared with a case that the solids concentration of a coating for a coated layer of ordinary coating paper for printing is 60-70%, sometimes the solids concentration of the coating for an undercoating layer is set to be approximately 40% or less. In said case, a binder component has a tendency to migrate (transfer) easily to lower part, accordingly, the distribution of the binder and orientation of the pigment in the coated layer become uneven. When a thermally sensitive recording layer is formed on it, thermal energy is not transmitted uniformly and causes an uneven problem of the dots, therefore, the quality of the recorded image is deteriorated. On the other hand, in the present invention, by blending a water-retention agent, especially, sodium alginate, to a coating, improvement of the water-retention ability and fluidity can be expected. Accordingly, migration of a binder is prevented and a uniform coated layer can be obtained.

In the undercoating layer of the present invention, starches and derivatives, modified starches and derivatives, polyvinylalcohols and derivatives, modified polyvinyl alcohols and derivatives, methylcellulose, carboxymethylcellulose, water-soluble polymers such as styrene-maleic anhydride, emulsions of synthetic resins such as a styrene-butadiene copolymer, acrylic acid copolymer, urethane resin or vinyl acetate can be added.

Formation of an undercoating layer can be easily carried out by coating a coating liquid over a substrate such as paper, reclaimed paper, plastic film or synthetic paper using an ordinary coating machine by 1-15 g/m$^2$ coating amount. As a coating method, an air knife method, blade method, gravure method, roll coater method or curtain method can be mentioned and any kind of method can be used, however, from the view point that coating by a high concentration is possible and a coating liquid does not penetrate easily into a substrate and a uniform layer can be formed, it is desirable to form an undercoating layer by a blade coater method.

As a pigment to be contained in the undercoating layer, a pigment whose oil-absorbing capacity (JIS K 5105) is from 80 cc/100 g to 120 cc/100 g is preferably used and not restricted, however, as a kind of pigment, clay (kaolin), calcined clay (calcined kaolin), calcium carbonate, aluminum oxide, titanium dioxide, magnesium carbonate, amorphous silica or colloidal silica can be mentioned. In particular, calcined clay is most desirable, because a thermally sensitive recording medium which is well-balanced in recording sensitivity and quality of image can be obtained. By using the calcined clay, it is considered that sufficient adiabatic effect is provided and sensitivity is improved, further, since a binder is not absorbed by a pigment so much, a uniform coated layer is formed and an excellent quality of image can be obtained. In the meanwhile, when calcined clay is used, since the shape of calcined clay is flat, the fluidity of a coating is generally inferior compared with a coating containing calcium carbonate or others whose shape is spherical, further, since an OH group (hydroxyl group) of silanol does not exist on the surface because it is calcined, bonding with water becomes weak and it has a tendency to deteriorate the water-retention ability of a coating liquid.

On the other hand, in the present invention, by the effect of a water-retention agent, in particular, sodium alginate, in a case when calcined clay is used, the coating aptitude is improved. Compared with polyvinylalcohol or carboxy methylcellulose, sodium alginate is superior in adhesive uniformity of solution. Therefore, the protective colloid function becomes large and it is considered that this characteristic acts effectively. To a coating liquid for an undercoating layer, a dispersing agent, wax, thicker, surfactant, UV-absorbing agent, antioxidant, water-repellent agent or oil-repellent agent can be added when a need is arisen.

It is desirable that the Brookfield viscosity (B viscosity) of a coating liquid for an undercoating layer at 25° C. is 200-1500 mPa·s. Further, it is desirable that the viscosity at shearing speed of $4.0\times10^{-5}$ sec$^{-1}$-$8.0\times10^{-5}$ sec$^{-1}$ at 25° C. (high shear viscosity) is 20-100 mPa·s, more desirably is 30-50 mPa·s. Said B viscosity is a viscosity corresponding to the shear when a coating liquid is supplied to a substrate by an applicator, while said high shear viscosity is a viscosity corresponding to the shear when a coating is scraped off from a substrate by a scraper.

When a coating liquid is supplied to a substrate by an applicator, if the coating does not have an adequate viscosity, the uniform supply of the coating liquid becomes difficult. For example, in a case when the viscosity of the coating is too low, a problem that the necessary coating amount cannot be obtained is caused because the pick-up amount of the coating liquid by an applicator roll becomes small. On the other hand, when the viscosity of the coating liquid is too high, a problem may be caused in a pump-up process.

In general, regarding a blade coater method such as bar blade, the formation of a stable (uniform) coated layer is not possible without adding pressure of a certain range. In the blade coater method, when the pressure to scrape off a coating is too low, uniform scraping off of the coating is difficult and a uniform coated layer cannot be formed, while when the pressure to scrape off a coating is too high, a problem that a substrate is broken is caused. Therefore, in the blade coater method, when the viscosity to the shear at the scraping off process is too small, the coating liquid is easily scraped off and a necessary coating amount cannot be obtained. In the meanwhile, when the high shear viscosity is too high, it is difficult to scrape off the coating to the aimed coating amount.

On the other hand, in the present invention, by using a coating which indicates the above viscosity, the migration of the coating into a substrate is prevented and a uniform coated layer with good covering ability is formed.

A thermally sensitive recording layer to be formed on an undercoating layer can be formed according to conventional well-known methods.

As a colorless or pale-colored basic leuco dye to be used with the thermally sensitive recording medium of the present invention, all publicly-known dyes which are well-known in conventional pressure-sensitive or thermally-sensitive recording paper fields can be used and are not restricted, however triphenylmethane compounds, fluorane compounds, fluorene compounds or divinyl compounds can be desirably used. Specific examples of a colorless or pale-colored basic leuco dye are shown below. These compounds can be used alone or can be used in combination.

<Triphenyl Methane Leuco Dye>

3,3'-bis(p-dimethylaminophenyl)-6-dimethylaminophthalide (another name; Crystal Violet Lactone)

3,3-bis(p-dimethylaminophenyl)phthalide (another name is Malachite Green Lactone)

<Fluorane Leuco Dyes>

3-diethylamino-6-methylfluorane
3-diethylamino-6-methyl-7-anilinofluorane
3-diethylamino-6-methyl-7-(o,p-dimethylanilino)fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-n-dipentylamino-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-cyclohexylamino-6-chlorofluorane <Divinyl Leuco Dyes>

3,3-bis-[2-(p-dimethylaminophenyl)-2-(p-methoxyphenyl) ethenyl]-4,5,6,7-tetrabromo phthalide
3,3-bis-[2-(p-dimethylaminophenyl)-2-(p-methoxyphenyl) ethenyl]-4,5,6,7-tetrachloro phthalide
3,3-bis-[1,1-bis(4-pyrrolidinophenyl)ethylene-2-yl]-4,5,6,7-tetrabromophthalide
3,3-bis-[1-(4-methoxyphenyl)-1-(4-pyrrolidinophenyl)ethylene-2-yl]-4,5,6,7-tetra chlorophthalide <Others>

3-(4-diethylamino-2-ethoxyphenyl)-3-(1-ethyl-2-methylindol-3-yl)-4-azaphthalide
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide
3,6-bis(diethylamino)fluorane-γ-(3'-nitro)anilinolactam
3,6-bis(diethylamino)fluorane-γ-(4'-nitro)anilinolactam
1,1-bis-[2',2',2",2"-tetrakis-(p-dimethylaminophenyl)-ethenyl]-2,2-dinitrilethane
1,1-bis-[2',2',2",2"-tetrakis-(p-dimethylaminophenyl)-ethenyl]-β-naphthoyl ethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonic acid dimethyl ester.

As a color-developing agent to be used in the present invention, any kinds of publicly known color-developing agent which makes a colorless or pale-colored basic leuco dye develop color is suitable. As a specific example, for example, bisphenol A, 4-hydroxybenzoic acid esters, 4-hydroxyphthalic acid diesters, phthalic acid monoesters, bis-(hydroxyphenyl)sulfides, 4-hydroxy phenylarylsulfones, 4-hydroxyphenylarylsulfonates, 1,3-di[2-(hydroxyl phenyl)-2-propyl]-benzenes, 4-hydroxybenzoiloxy benzoic acid esters or bisphenolsulfones disclosed in the JP H3-207688 publication or the JP H5-24366 publication can be mentioned.

Further, in a thermally sensitive recording medium of the present invention, a conventional sensitizer can be used similar to the conventional thermally sensitive recording medium. As the specific example of the sensitizer, a fatty acid amide such as a stearic acid amide or parmitic acid amide, ethylenebisamide, montan wax, polyethylene wax, 1,2-di(3-methylphenoxy)ethane, p-benzylbiphenyl, β-benzyloxynaphthalene, 4-biphenyl-p-tolyl ether, m-terphenyl, 1,2-diphenoxyethane, dibenzyl oxalate, di(p-chlorobenzyl) oxalate, di(p-methylbenzyl)oxalate, dibenzylterephthalate, benzyl p-benzyloxybenzoate, di-p-tolylcarbonate, phenyl-α-naphythylcarbonate, 1,4-diethoxynaphthalene, phenyl 1-hydroxy-2-naphthoate, 4-(m-methylphenoxymethyl)biphenyl, 4,4'-ethylenedioxy-bis-dibenzylbenzoate, dibenzoyloxymethane, 1,2-di(3-methylphenoxy)ethylene, bis[2-(4-methoxy-phenoxy)ethyl]ether, methyl p-nitrobenzoate or phenyl p-toluenesulfonate can be mentioned, however, it is not restricted to these compounds. These sensitizers can be used alone or can be used in combination.

Further, as an image stabilizer which displays resistance effect to oil of recorded image, 4,4'-butylidene(6-t-butyl-3-methylphenol), 2,2'-di-t-butyl-5,5'-dimethyl-4,4'-sulfonyldiphenol, 1,1,3-tris(2-methyl-4-hydroxy-5-cyclohexylphenyl)butane or 1,1,3-tris(2-methyl-4-hydroxy-5-t-butylphenyl)butane can be added.

Still further, a releasing agent such as a metal salt of fatty acid, a slipping agent such as waxes, a UV-absorbing agent such as benzophenones or triazoles, a water-resistant agent such as glyoxal, a dispersing agent, a defoaming agent, an antioxidant or a fluorescent dye can be used.

The kind and amount of components, e.g. basic leuco dye, color-developing agent or others to be used in the thermally sensitive recording medium of the present invention are decided according to the required properties and recording aptitude and not restricted, however, in general, 0.5-10 parts of color-developing agent and 0.5-10 parts of filler to 1 part of the basic leuco dye are used.

The basic leuco dye, color-developing agent and other materials to be added by necessity are pulverized by a grinder such as a ball mill, attriter or sand grinder, or by means of an adequate emulsifying apparatus, until they are pulverized under several microns size, then is added an acrylic emulsion, colloidal silica and various additives according to the object, thus a coating is prepared. The coating amount of a thermally sensitive recording layer is not particularly restricted, however, it preferably is in the range of 2-12 g/m$^2$ by dry weight. The means for coating is not restricted and publicly known conventional methods can be used, for example, an off machine coater with various coaters such as an air knife coater, a rod blade coater, a bill blade coater, a roll coater or a curtain coater or an on machine coater can be voluntarily chosen and used. Among these machines, a curtain coater process is desirable, because said process provides a good printed image.

As one of the grounds for a deteriorated printed image, the following reasoning can be mentioned. When a thermally sensitive recording layer is formed on an undercoating layer by a blade coating method, which is a generally used method, the surface of the thermally sensitive recording layer becomes smooth by the scraping action of a blade, however, the surface of the undercoating layer is directly affected by the uneven surface of a substrate paper and is not so smooth compared with the surface of the thermally sensitive recording layer. Consequently, the thickness of the thermally sensitive recording layer becomes unequal and the existing quantity of the color-developing materials becomes different from position to position. Therefore, when the thermal energy is applied, the degree of the developed color becomes uneven, especially in a case of high energy printing, the developed color becomes deeper at a thicker position and it is difficult to obtain an excellent quality in a printed image. On the other hand, in the case of a curtain coater method, a coating liquid is not scraped off and an outline coating is possible, that is, the thermally sensitive recording layer can be formed so as to go along with the outline of the undercoating layer. Therefore, the thickness of the thermally sensitive recording layer becomes even, so that the unevenness of the printing density may be prevented and the printed image can be improved.

The thermally sensitive recording medium of the present invention can provide an overcoating layer composed of a polymer on the thermally sensitive recording layer for the purpose of improving the preservability, or can provide an undercoating layer composed of a polymer containing a filler under the thermally sensitive recording layer. On the opposite side of the substrate to the thermally sensitive layer, a backcoat layer can be provided for the purpose of correcting the curling of the medium. Further, various publicly-known techniques in the field of thermally sensitive recording mediums can be added, for example, carrying out a smoothing treatment such as super calendaring after the coating process of each layer.

As a substrate of the thermally sensitive recording medium of the present invention, paper, recycled paper, synthetic paper, film, plastic film, plastic foam film or non-woven cloth can be properly selected and used according to use. A composite sheet which is prepared by combining these substrates can be used as a substrate.

EXAMPLE

The thermally sensitive recording medium of the present invention will be illustrated according to the Examples. In illustration, "parts" and "%" indicates "weight parts" and "weight %".

Solutions, dispersions or coating liquids are prepared as follows.

Example 1

A mixture of the following blending ratio is stirred and dispersed, and coating liquids for an undercoating layer are prepared to have the solids concentration and dynamic water-retention capacity indicated in Table 1.

| U solutin (coating for undercoating layer) | |
|---|---|
| Calcined clay (product of Engelhard Co., Ltd., commodity name; Ansilex 90, <oil absorbing capacity 90 cc/100 g>) | 100 parts |
| Styrene•butadiene copolymer latex (solid part 48%) | 40 parts |
| 10% aqueous solution of polyvinylalcohol | 30 parts |
| 2% aqueous solution of sodium alginate | 5 parts |

(viscosity of 1% aqueous solution: 600-900 mPa · s, product of Kelco Co., Ltd., commodity name; Kelgin HV)

The obtained coating for an undercoating layer is coated onto one surface of a substrate (paper of 60 g/m$^2$) using a blade coater, then dried and an undercoating layer of a coating amount of 10.0 g/m$^2$ is obtained.

Dispersions of the following blending ratio for each material for a color-developing agent (A solution) and basic leuco dye (B solution) are prepared, and are ground separately in a wet condition by using a sand grinder to an average particle size of 1 μm.

| A solution (dispersion of color developing agent) | |
|---|---|
| 4-hydroxy-4'-isopropoxydiphenylsulfone | 6.0 parts |
| 10% aqueous solution of polyvinyl alcohol | 18.8 parts |
| water | 11.2 parts |
| **B solution (dispersion of basic leuco dye)** | |
| 3-dibutylamino-6-methyl-7-anilinofluorane | 2.0 parts |
| 10% aqueous solution of polyvinyl alcohol | 4.6 parts |
| water | 2.6 parts |

Then these dispersions are mixed by the following ratio and a coating for recording layer is prepared

| Coating liquid for a recording layer | |
|---|---|
| A solution (dispersion of color developing agent) | 36.0 parts |
| B solution (dispersion of basic leuco dye) | 9.2 parts |
| Kaolin clay (50% dispersion) | 12.0 parts |

Then the obtained coating liquid for the recording layer is coated on the undercoating layer by a blade coater so that the coating quantity is 4 g/m$^2$ and dried. This sheet is treated by a super calendar so that the smoothness to be 500-600 sec and a thermally sensitive recording medium is obtained.

Example 2

By the same process as Example 1, except for coating the recording layer on the undercoating layer of said undercoating layer forming paper by a curtain coater instead of a blade coater, a thermally sensitive recording medium is obtained.

Example 3, Example 4

By the same process as Example 1, except for adjusting the solids concentration and dynamic water-retention capacity of the coating for the undercoating layer as shown in Table 1, a thermally sensitive recording medium is obtained.

Example 5

By the same process as Example 1, except for changing the blending ratio of 2% aqueous solution of sodium alginate of U solution (coating for undercoating layer) to 2.5 parts, a thermally sensitive recording medium is obtained.

Example 6

By the same process to Example 1, except for changing the blending ratio of 2% aqueous solution of sodium alginate of U solution (coating for undercoating layer), a thermally sensitive recording medium is obtained.

Comparative Example 1

By the same process as Example 1, except for not blending 2% aqueous solution of sodium alginate in preparation of U solution (coating for undercoating layer), a thermally sensitive recording medium is obtained.

Comparative Example 2, Comparative Example 3

By the same process as Example 1, except for adjusting the solids concentration and dynamic water-retention capacity of the coating for the undercoating layer as shown in Table 2, a thermally sensitive recording medium is obtained.

In Comparative Example 2, sodium alginate whose viscosity of 1% aqueous solution is 40-80 mPa·s (product of Kelco Co., Ltd., commodity name; Kelgin LV) is used as sodium alginate.

Further, in Comparative Example 3, precipitated calcium carbonate (product of Shiraishi Kogyo Co., Ltd., commodity name; Brilliant 15, oil-absorbing capacity at 43 cc/100 g) is used.

<Evaluation of Color Developing Sensitivity>

Prepared specimens of a thermally sensitive recording medium are subjected to printing at an applied energy of 0.344 mJ/dot by using TH-PMD (printing test machine for thermally sensitive recording paper, thermal head of Kyocera Co., Ltd is installed) product of Okura Denki Co., Ltd. The image densities of the recorded part are measured and evaluated by using a Macbeth Densitometer (RD-18i).

<Evaluation of Printed Image>

Printed part is evaluated by visual inspection.

○: white spots are not observed

Δ: white spots are observed x: many spots are observed

<Evaluation of Coating Aptitude>

The coating runability and the obtained coated surface are evaluated.

○: coating can be done without any problem, and the condition of coated surface by visual inspection is good.

Δ: coating can be done without big problems, however, sometimes, problems like streaking or staining of a roller are observed, and long term stable coating is difficult.

x: coating defects such as streaking during the coating process and stable coating is impossible.

<Measuring Method of Dynamic Water-Retention Capacity>

Dynamic water-retention capacity is measured by Water Retention Meter, product of Kaltec Scientific Co., Ltd., using a specified film (filter) "AA-GWR Test Filters (KALTEC SCIENCE, Inc.), GWR420" and a filtering paper "Whatmans Chromatography 17". When this value is small, it indicates a high dynamic water-retention capacity and a high water-retention ability right under a blade and defects such as streaking are not caused easily on a coated surface.

TABLE 1

| | | Example No. | | | | | |
|---|---|---|---|---|---|---|---|
| | | 1 | 2 | 3 | 4 | 5 | 6 |
| undercoating layer | pigment | calcined clay | calcined clay | calcined clay | calcined clay | calcined clay | calcined clay |
| | water retention agent (name) | sodium alginate Kelgin HV | sodium alginate Kelgin HV | sodium alginate Kelgin HV | sodium alginate Kelgin HV | sodium alginate Kelgin HV | sodium alginate Kelgin HV |
| | contents * | 0.1 | 0.1 | 0.1 | 0.1 | 0.05 | 1.2 |
| | conc. of solid of a coating % | 38 | 38 | 35 | 32 | 38 | 38 |
| | dynamic water-retention capacity | 280 | 280 | 323 | 342 | 330 | 270 |
| | B viscosity mPa · s | 1340 | 1340 | 580 | 340 | 960 | 1360 |
| | high shear viscosity mPa · s | 46 | 46 | 36 | 29 | 47 | 44 |
| thermally sensitive layer | coating method | blade | curtain | blade | blade | blade | blade |
| quality | sensitivity | ○ 1.33 | ○ 1.34 | ○ 1.33 | ○ 1.32 | ○ 1.32 | Δ 1.24 |
| | Printed image | ○ | ○ | ○ | Δ | Δ | ○ |
| coating aptitude | undercoating layer | ○ | ○ | ○ | ○ | ○ | ○ |

* parts (weight parts) to 100 weight parts to pigment

TABLE 2

| | | Comparative Example No, | | |
|---|---|---|---|---|
| | | 1 | 2 | 3 |
| undercoating layer | pigment | calcined clay | calcined clay | calcined clay |
| | water retention agent (name) | no | sodium alginate Kelgin LV | sodium alginate Kelgin HV |
| | contents | | 0.1 | 0.1 |
| | conc. of solid of a coating % | 38 | 38 | 38 |
| | dynamic water-retention capacity | 420 | 390 | 200 |
| | B viscosity mPa · s | 750 | 880 | 560 |
| | high shear viscosity mPa · s | 47 | 45 | 17 |
| thermally sensitive layer | coating method | blade | blade | blade |
| quality | sensitivity | ○ 1.35 | ○ 1.32 | X 1.09 |
| | printed image | X | X | Δ |
| coating aptitude | undercoating layer | Δ | Δ | ○ |

INDUSTRIAL APPLICABILITY

According to the present invention, a thermally sensitive recording medium which has a high recording sensitivity and superior printing image can be obtained by containing a water-retention agent, in particular, sodium alginate in an undercoating layer.

The invention claimed is:

1. A thermally sensitive recording medium comprising an undercoating layer containing a pigment and a binder as main components and a thermally sensitive color-developing layer containing a colorless or pale-colored basic leuco dye and a color-developing agent which develops color by reacting with said basic leuco dye as main components on a substrate, wherein said undercoating layer contains sodium alginate as a water-retention agent and a pigment whose oil-absorbing capacity prescribed by JIS K 5105 is from 80 cc/100 g to 120 cc/100 g as a pigment, the solids concentration of a coating for the undercoating layer is from 25% to 45% and dynamic water-retention capacity, measured according to AA-GWR, is 350 g/m$^2$ or less.

2. The thermally sensitive recording medium of claim 1, wherein the content of sodium alginate is 0.01 to 1 weight part to 100 parts of pigment.

3. The thermally sensitive recording medium of claim 1, wherein the Brookfield viscosity of 1% aqueous solution of the sodium alginate is 100 mPa·s or more.

4. The thermally sensitive recording medium according to claim 1, wherein the pigment whose oil-absorbing capacity prescribed by JIS K 5105 is from 80 cc/100 g to 120 cc/100 g is calcined clay.

5. The thermally sensitive recording medium according to claim 1, wherein the Brookfield viscosity at 25° C. of a coating for undercoating layer is 200-1500 mPa·s and viscosity at the shear rate of $4.0\times10^{-5}$ sec$^{-1}$ to $8.0\times10^{-5}$ sec$^{-1}$ at 25° C. of a coating for undercoating layer is 20-100 mPa·s.

6. The thermally sensitive recording medium according to claim 1, wherein the thermally sensitive recording layer is formed by a curtain coating method.

7. The thermally sensitive recording medium according to claim 1, wherein the solids concentration of the coating for the undercoating layer is from 25% to 45% and dynamic water-retention capacity is 350 g/m$^2$ or less.

8. A method for preparation of a thermally sensitive recording medium comprising, forming an undercoating layer containing a pigment and a binder as main components and a thermally sensitive color-developing layer containing a colorless or pale-colored basic leuco dye and a color-developing agent which develops color by reacting with said basic leuco dye as main components on a substrate, wherein said undercoating layer contains sodium alginate as a water-retention agent and a pigment whose oil-absorbing capacity prescribed by JIS K 5105 is from 80 cc/100 g to 120 cc/100 g as a pigment, the solids concentration of a coating for the undercoating layer is from 25% to 45% and dynamic water-retention capacity, measured according to AA-GWR, is 350 g/m$^2$ or less.

* * * * *